US005317852A

United States Patent [19]

Howland

[11] Patent Number: 5,317,852

[45] Date of Patent: Jun. 7, 1994

[54] ROOF CONSTRUCTION FOR LEAK DETECTION

[76] Inventor: Koert R. Howland, 3838 Francis, Kalamazoo, Mich. 49001

[21] Appl. No.: 799,031

[22] Filed: Nov. 27, 1991

[51] Int. Cl.[5] ..... E04B 7/00

[52] U.S. Cl. ..... 52/408; 52/90.1; 52/11; 52/302.1

[58] Field of Search ..... 52/408, 410, 404, 302.1, 52/90.1, 11, 1, 409

[56] References Cited

U.S. PATENT DOCUMENTS

| | | | |
|---|---|---|---|
| 2,861,525 | 11/1958 | Curtis et al. | 52/408 |
| 3,077,703 | 2/1963 | Bergstrom | 52/409 |
| 3,209,502 | 10/1965 | Donegan | 52/408 |
| 3,455,076 | 7/1969 | Clarvoe | 52/408 |
| 3,466,222 | 9/1969 | Curtis | 52/408 X |
| 3,498,015 | 3/1970 | Seaburg et al. | 52/302.1 X |
| 3,884,009 | 5/1975 | Frohlich et al. | 52/302.1 X |
| 4,110,945 | 9/1978 | Sheahan | 52/173 R |
| 4,114,335 | 9/1978 | Carroll | 52/302.1 X |
| 4,317,996 | 3/1982 | Davis | 250/302 |
| 4,441,295 | 4/1984 | Kelly | 52/48 |
| 4,446,664 | 5/1984 | Harkins | 52/404 |
| 4,449,336 | 5/1984 | Kelly | 52/408 X |
| 4,573,298 | 3/1986 | Harkins | 52/404 |
| 4,609,305 | 9/1986 | Groeneveld | 52/408 X |
| 4,924,174 | 5/1990 | Sheahan | 52/173 R X |
| 5,069,950 | 12/1991 | Crookston | 52/302.1 X |
| 5,144,782 | 9/1992 | Paquette et al. | 52/408 |

*Primary Examiner*—Carl D. Friedman
*Assistant Examiner*—Robert J. Canfield
*Attorney, Agent, or Firm*—Waters & Morse

[57] ABSTRACT

The layers of materials constituting the sub-roof under a water-impervious membrane are adapted to provide localized downward drainage passages to a drop-off point that is detectable from underneath the roof. The location of the leak is thus identified within a spacing of these passages. The rupture of the membrane causing the leakage is then easily repaired with a minimum disturbance to the roof structure.

5 Claims, 6 Drawing Sheets

FIG. 1

ROOF CONSTRUCTION FOR LEAK DETECTION

BACKGROUND OF THE INVENTION

Roofs having slopes approaching the horizontal have special problems in the prevention of leakage. This roof configuration is common in commercial buildings, and thus generates considerable maintenance. Typically, such a roof will slope at one foot or less per 12 feet of horizontal distance. Rain water or thawing ice is the source of the leakage, and this is compounded by the presence of remaining snow and ice that can interfere with expected drainage. So-called "membrane roof construction" was intended to correct the leakage problem, but produced its own set of problems with the passage of time. A membrane roof normally includes some form of truss system for support, and a layered sub-roof assembly extending between the support points. A film of water-impervious material (either in sheet form, or poured from initially-liquid material) is placed on top of the sub-roof. All is fine until a leak occurs somewhere. The film is supposedly protected by "ballast" material, which commonly is in the form of crushed stone or gravel. A service man walking across the roof can easily and inadvertently punch one of the stones through the film. The expected shrinkage and expansion of the roof components can also induce small ruptures in the film.

Leakage through one of these film discontinuities seems to intentionally defy attempts to locate it for repair. After moving laterally along the underside of the roof components, it can easily become first visible in the walls of the building, perhaps 30 feet from the location of the leak. Where the lateral flow takes place between the layered roof components, it may be necessary to tear off a large section of the roof to find it. This is particularly a problem when corrugated sheet material is used for bridging across between the support members. Insulation panels usually are laid over the corrugated sheet, forming concealed channels for the movement of water. Even noncorrugated layers of a roof have a tendency to provide minute passages between them for the concealed lateral movement of leakage before it becomes detectable. It must be kept in mind that the surface tension of wate will enable it to cling to the underside of a roof component, as well as ride along on top of it.

SUMMARY OF THE INVENTION

This invention provides a roof construction that causes leakage to become visible adjacent the leak location by providing localized passages through the sub-roof layers at closely-spaced intervals. These passages are placed so that water passing down through them will drop freely from the sub-roof to provide clear evidence of the location of the leak, which can then be repaired by reworking a very small area of the membrane and the surrounding roof structure. Water passing through a rupture in the membrane is directed immediately to these passages.

DESCRIPTION OF THE PREFERRED EMBODIMENTS

Figure 1:
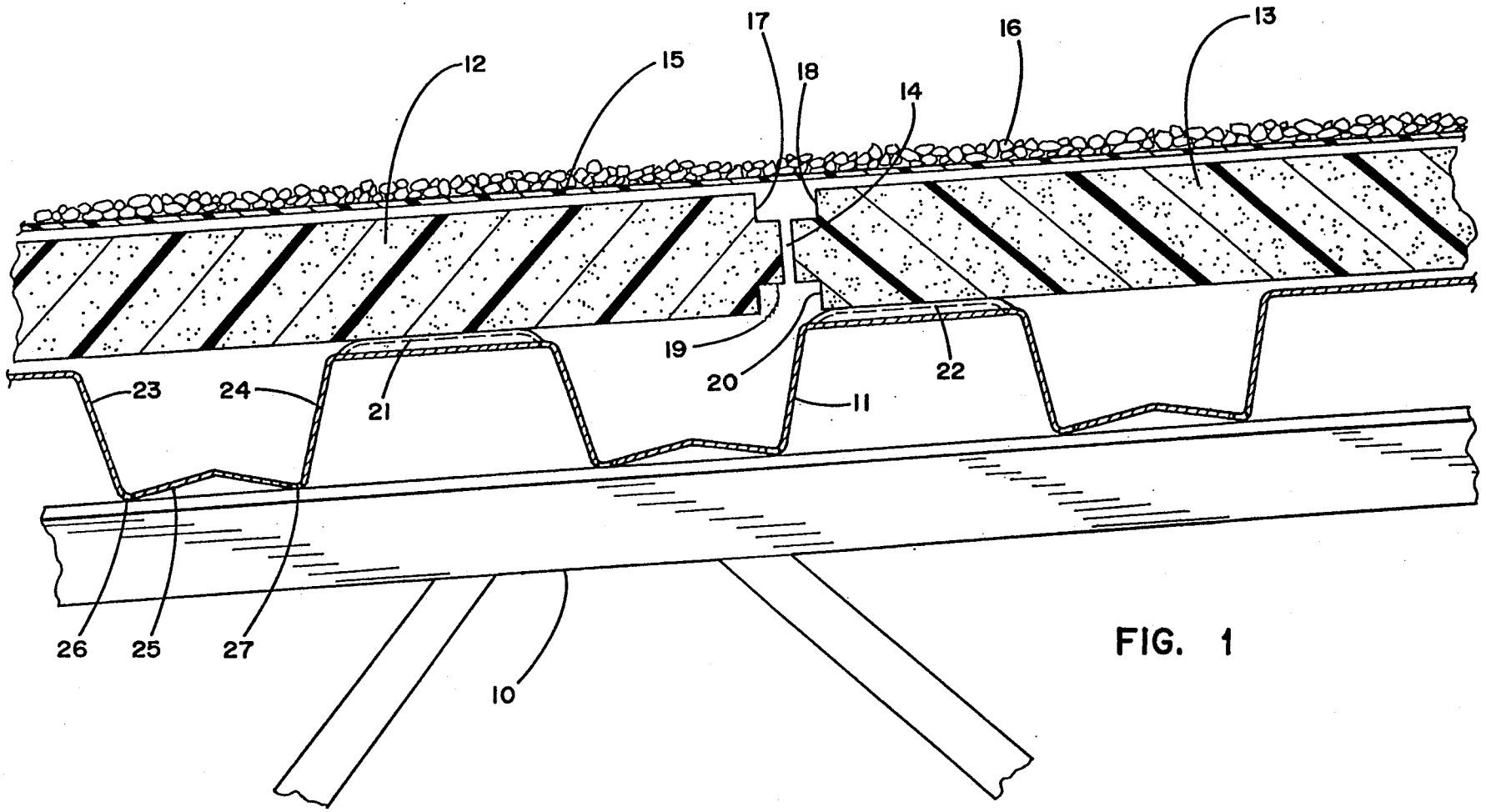
FIG. 1 is a fragmentary sectional elevation of a roof structure in which corrugated sheet metal is used to bridge between spaced trusses, and supports the remainder of the sub-roof, membrane, and ballast.

Referring to FIG. 1, the illustrated roof construction has a primary slope downward from right to left. The roof, together with any load that it may be carrying, is supported by the spaced trusses 10. The sub-roof components include the panels of corrugated sheet metal 11 bridging between the trusses 10, with the corrugations extending transversely to the principal slope of the roof. Insulation panels 12 and 13 are supported by the corrugated panels 10, and are spaced around their peripheral edges as shown at 14 to provide a downward passage for water that may leak through ruptures in the membrane 15. Loose material commonly referred to as "ballast" is indicated at 16, and is usually in the form of gravel or crushed stone. Any water leaking through a puncture in the membrane will usually work its way downward along the slope to a point where it encounters the space between the insulation panels. Because of surface tension, water has a tendency to bridge across small gaps; and for this reason the peripheral edges of the insulation panels are offset as shown at 17 and 18 to provide a vertical discontinuity and a localized wider gap, so that the water will move downward through the space 14, rather than to continue to follow the upper surfaces of the insulation panels. Water moving downward through this gap would also tend to adhere to the undersurface of these panels, were it not for the similar offsets 19 and 20 on the underside of the panel edges. To be fully effective in terminating the down-run of the water, the upper extremities of the offset 19 should be sloped with an angle such that water moving down the gap would have to go uphill to continue down along the underside of the panel. Without this provision, it is conceivable that water can move downward through the gap 14, and follow the contour of the offset 19 to the underside of the panel, and move from there further to the left along the slope of the roof. However, at the next encounter of a panel junction, this flow of water would stop, as it will encounter an offset similar to that indicated at 20, and will not climb up the offset to continue its movement along the slope.

Figure 2:
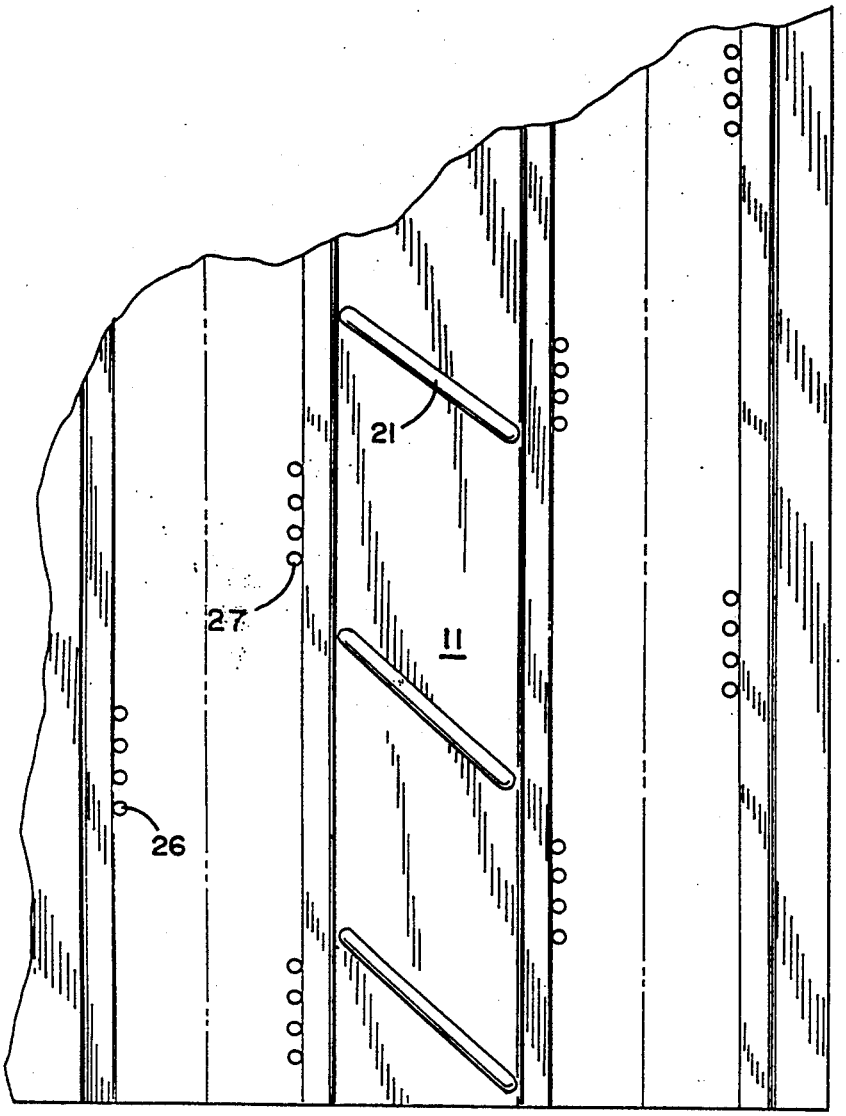
FIG. 2 is a fragmentary plan view of a portion of the sheet metal appearing in FIG. 1.

It is common practice to provide some degree of compound slope to a roof, so that some of the slope will be downward in the direction of the corrugations of the sheet metal. Leakage water tending to move in the direction perpendicular to FIG. 1 in between the top of the corrugation ridges and the underside of the insulation panels will be deflected laterally by the formed ridges 21 and 22 extending above the principal top surface of the corrugations. These are disposed at an angle to assist in the displacement of the leakage flow from the underside of the insulation panels down into the troughs of the corrugations. Each of the troughs has a sidewall as shown at 23 and 24, and an upwardly convex bottom 25. Adjacent the junction of the bottom 25 and sidewalls, a series of holes as shown at 26 and 27 is spaced along the corrugations to provide an outlet for drainage seeping into these troughs. At this point, water will fall through the holes 26 and 27, and be immediately obvious to inspection from the space below the roof. The convexity of the bottom 25 deflects the leakage flow laterally into the area of the holes, which should be at least a quarter of an inch in diameter to avoid a tendency for the surface tension of the water to bridge across or around the holes to continue movement along the secondary slope of the roof. FIG. 2 shows this configuration of the corrugated sheet metal from above, without the presence of the roof components normally above it. In the usual roof construction, these components are laid down in sequence. The membrane may be in the form of plastic film that is unrolled as it is laid in place, and sealed to adjacent film material around the edges. The membrane also may be of initially pourable material that solidifies to a more or less continuous film to deflect the water down the slope of the roof.

Figure 3:
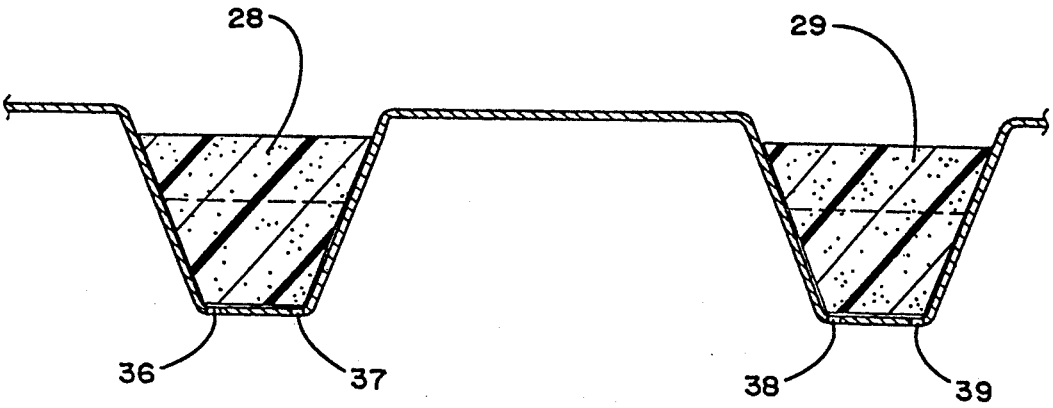
FIG. 3 is a sectional elevation of a modified form of the invention incorporating dams in the channels provided by the corrugated sheet metal. The upper layers of the roof structure are omitted.
Figure 4:
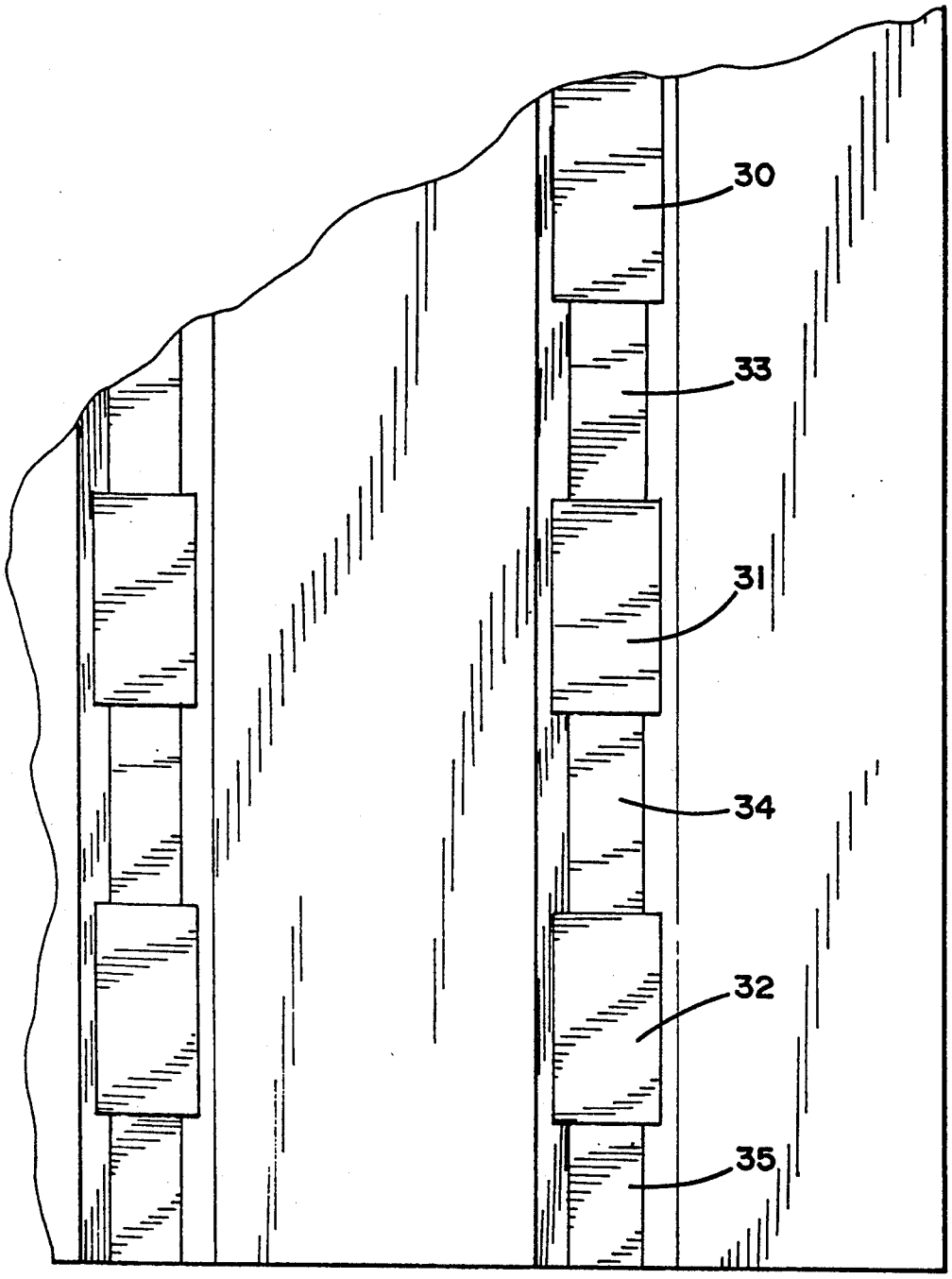
FIG. 4 is a plan view of the structure shown in FIG. 3.

It may be desirable to localize the leakage which may be flowing along the channels provided by the corrugated sheet metal. In such cases, the arrangements shown in FIGS. 3 and 4 may be utilized. Inserts of open-celled foam may be installed in these channels, as shown at 28 and 29. Each of these inserts has a series of high points as shown at 30–32 in FIG. 4, which approach the full depth of the channels. These high portions are separated by the portions 33–35 of shallower depth, and the space above these can form a reservoir which accumulates and slows the drainage movement of the water. The open-celled structure of these inserts permits the water to seep through them down to the bottoms of the troughs, where it emerges through the holes 36–39 as shown in FIG. 3.

Figure 5:
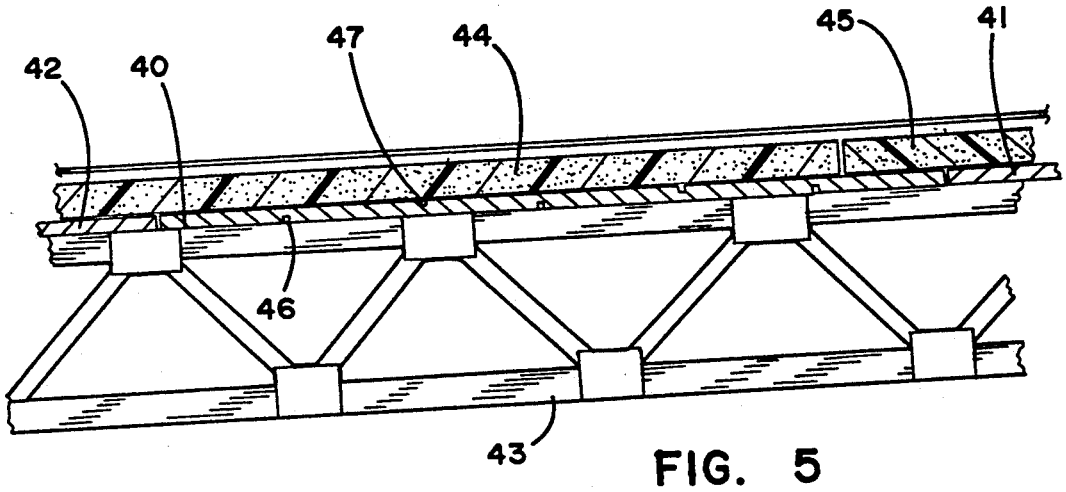
FIG. 5 is a sectional elevation of a modified form of the invention, in which the corrugated sheet metal is replaced by plywood sheets.

Referring to FIG. 5, a construction is illustrated which makes use of heavy plywood panels, rather than corrugated sheet metal. These panels 40, 41, and 42 bridge across the trusses 43 to support the insulation panels 44 and 45, together with the membrane and ballast. Both the plywood bridging panels and the insulation panels are spaced around their edges, as previously described. The spacing can be provided by any standard device interposed between the adjacent edges. In addition to this spacing, the plywood panels are grooved on preferably both the upper and lower surfaces, as shown at 46 and 47 at regular intervals. The grooves on the underside inhibit the adhering of water to the underside of the panels, so that the leakage is conveniently localized. Where a significantly compound slope is involved, it may be necessary to occasionally plug the underside grooves to prevent a continuing run of water down the secondary slope. Occasional holes drilled through the grooves 47 will also permit leakage to pass through to a point where it can be detected from underneath. A small tube inserted in such holes, and extending slightly below the undersurface of the panels will tend to prevent lateral running along the underside where that factor may be a problem.

Figure 6:
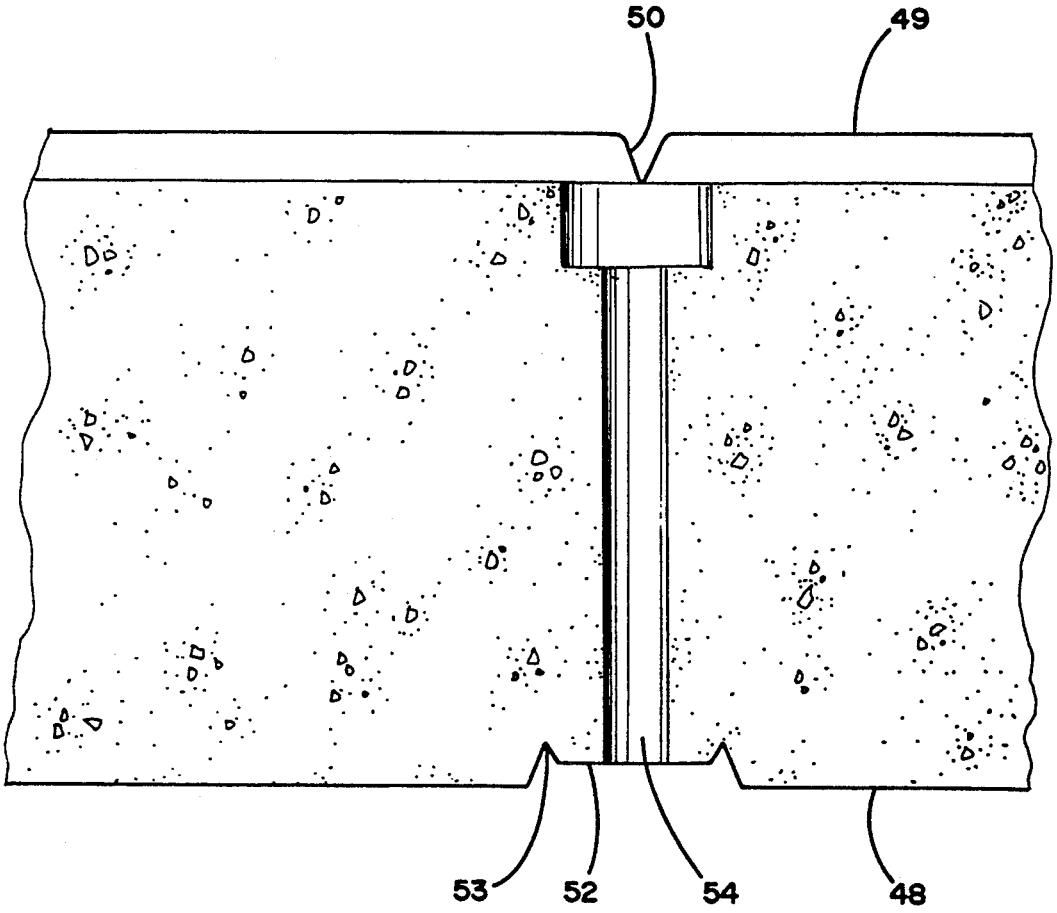
FIG. 6 illustrates a modification of the invention in which the system is incorporated in a poured concrete roof.
Figure 7:
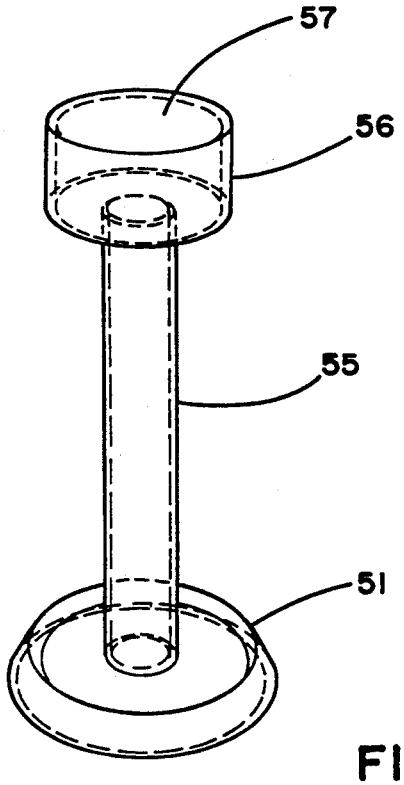
FIG. 7 is a perspective view showing a form insert used to provide the drain configuration appearing in FIG. 6.

Referring to FIG. 6, an arrangement is shown for the detection of leakage in a roof structure based upon poured concrete. The usual metal or plywood forms will establish the underside 48 of the poured concrete, which extends upward to the top surface 49 determined by the usual screed. Spaced grooves as shown at 50 are cut into the wet concrete to control the formation of cracks that develop later as a result of changes in temperature and moisture. These control joint grooves 50 form convenient troughs for the accumulation of leakage, which would otherwise move through cracks that may occur at random. To get this leakage down to where it appears from below, a form insert is applied prior to the pouring of the concrete. This form insert is of the type shown in FIG. 7, where a base flange 51 produces the recess 52 shown in FIG. 6. The configuration of the flange 51 produces the vertical offset 53 completely surrounding the opening of the hole 54, so that any water draining down through the hole cannot move laterally beyond the offset 53. After the concrete has set, and the forms stripped, the insert shown in FIG. 7 may either be stripped out in its entirety, or simply have the base flange 51 removed. Normally, the insert will be located in the form prior to the pouring of the concrete by securing the base flange to the form panels with a nail or some other form of fastening. Referring again to FIG. 7, the tube 55 extends from the base flange 51 upward to a cylindrical receptacle 56 with a top 57. The entire unit will normally be of relatively light plastic material, and will be left in place whether the tube 55 is pulled out from below or not. The insert shown in FIG. 7 is placed so that the top 57 is about tangent to the underside of the crack-control grooves 50. After the concrete has set, a hole is easily drilled through the base of the grooves 50 and the top 57 so that the container 56 forms a receptacle to the drainage that accumulates. Normally, the receptacle shown in FIG. 7 will be placed at an intersection of grooves 50, which are normally laid in a regular grid across the top surface of the concrete.

Figure 9:
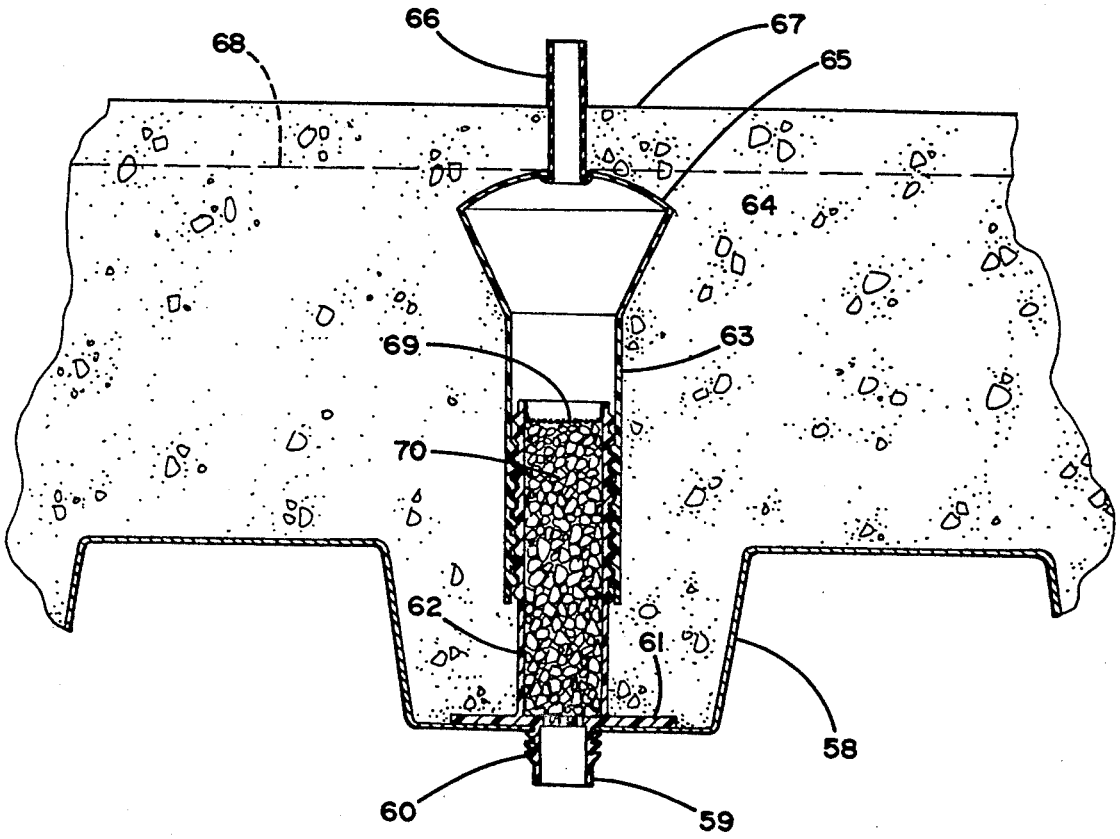
FIG. 9 illustrates a modification of the form insert used in conjunction with poured concrete, in which the unit is vertically adjustable.

FIG. 9 shows a modified form of insert usable for providing drainage down through the poured concrete. In this instance, the insert is shown mounted on a form panel which happens to be corrugated sheet metal. The form insert shown in FIG. 9 will normally remain embedded in the concrete in its entirety. Holes are drilled in the corrugated sheet metal 58 of the form to receive the tubular lower extension 59 of the insert. The insert will normally be of somewhat resilient plastic material, and will have a serrated periphery as shown at 60 on the extension 59 to secure the insert in place. A base flange 61 on the lower tubular member 62 of the insert stabilizes the position of the insert. An exterior tubular member 63 is in telescoping relationship with the lower tubular section. The exterior tubular member 63 terminates at its upper extremity at the flared funnel-shaped portion 64, with a dome-shaped top 65. A highly flexible tube 66 is engaged with a central hole in the top 65, which the screed easily deflects as it passes over the concrete to establish the full depth indicated at 67. It is intended that the groove 68 should be approximately tangent to the top of the dome surface 65, the curvature of the top being easily capable of deflecting the grooving tool, or yielding to it. The telescoping relationship between the inner and outer tubes 62 and 63 permits a careful adjustment of the height of the assembly to where the position of the top 65 can easily be controlled with precision. Tubular member 62 is preferably provided with a cap 69 which permits the interior of the lower tubular member to function as a container for a mass of fireproof granular material 70 such as Perlite which will form only a limited obstruction to the downflow of water to where it can emerge from the bottom of the unit. In many cases, the form 58 will remain as an integral part of the structure, acting as a reinforcement to the concrete. After the concrete has set, and immediately before the roofing materials are applied, the flexible tube 66 is pulled from the bottom of groove 68 to allow unobstructed flow into the top 65.

Figure 8:
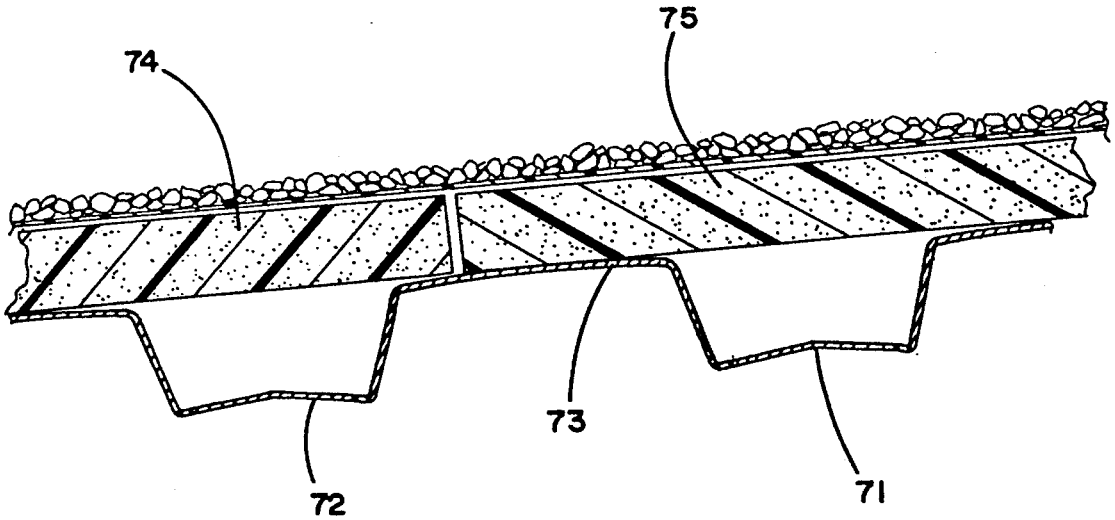
FIG. 8 shows a modification of the invention in which the standard configuration of the corrugated sheet is modified to induce lateral flow of leakage off from the ridges and into the valleys which have the drainage openings.

Referring to FIG. 8, a somewhat modified form of laminated roof construction uses a corrugated sheet configuration differing slightly from that previously described. The bottoms 71 and 72 of the troughs are as shown previously, but the tops 73 are curved upwardly a slight amount to deflect drainage moving downward between the edges of the insulated panels 74 and 75 so that the water tends to flow off into the adjacent channels, rather than downwardly along the secondary slope of the roof between the tops 73 and the underside of the insulatio panels. This arrangement is particularly desirable where the tops 73 extend along the gap between the insulation panels, and thus form a support to both edges because of the shallow curvature.

I claim:

1. A multi-layered roof construction adapted for placement over spaced support means, comprising:

a sub-roof structure including bridging panel means extending between said support means, sand having a plurality of parallel grooves having lower extremities, said panel means having perforations in said lower extremities;

second panel means superimposed on said bridging panel means, and including a plurality of panel sections in spaced edge-to-edge relationship providing paths for the downward movement of small quantities of water; and means forming a film superimposed on said second panel means, said film being substantially impervious to water where said film is continuous.

2. A roof construction as defined in claim 1, wherein said bridging panel means is at least one corrugated sheet.

3. A roof construction as defined in claim 1, wherein said perforations are holes at least one-quarter of an inch in diameter.

4. A roof construction as defined in claim 1, wherein said lower extremities are upwardly-convex, and said perforations are along opposite edges thereof.

5. A roof construction as defined in claim 1, wherein said roof construction has a slope, and said grooves are transverse to said slope.

* * * * *